US007861539B2

(12) United States Patent
Wu

(10) Patent No.: US 7,861,539 B2
(45) Date of Patent: Jan. 4, 2011

(54) COOLING FAN WITH THERMOSTATIC AIR OUTPUT

(76) Inventor: Chung-E Wu, 3F.-3, No. 391, Sec. 3, Jhonghua E. Rd., East District, Tainan City 701 (TW) 701

( * ) Notice: Subject to any disclaimer, the term of this patent is extended or adjusted under 35 U.S.C. 154(b) by 354 days.

(21) Appl. No.: 12/068,885

(22) Filed: Feb. 13, 2008

(65) Prior Publication Data

US 2008/0199305 A1 Aug. 21, 2008

(30) Foreign Application Priority Data

Feb. 15, 2007 (TW) ..... 96105625 A

(51) Int. Cl.
*F25B 21/02* (2006.01)

(52) U.S. Cl. ..... 62/3.64; 62/389

(58) Field of Classification Search ..... 62/3.2, 62/3.64, 389, 3.3

See application file for complete search history.

(56) References Cited

U.S. PATENT DOCUMENTS

2002/0184906 A1* 12/2002 Faries, Jr. ..... 62/229

* cited by examiner

*Primary Examiner*—Melvin Jones
(74) *Attorney, Agent, or Firm*—Bacon & Thomas, PLLC

(57) ABSTRACT

A cooling fan with thermostatic air output has a water cistern and a water reservoir respectively disposed on the top portion and the bottom portion of the fan body, wherein an electric fan and two pipes of recycling pipe and water outlet pipe for water circulation are disposed therein; Wherein a Thermoelectric Cooling Modules (TECM) is secured in said water cistern, and a water absorbing curtain is hung downwards between the wind inlet of said fan body and said electric fan such that the top end of said water absorbing curtain being immersed in the water cistern; Then, by means of the sucking function of said electric fan in front of said water absorbing curtain, the air of normal temperature from wind inlet is sucked and blown out of the wind outlet via said water absorbing curtain, where the inlet air mixing with moisture of lower temperature; Thus, the cooling effect in breeze of lower temperature by blowing action is achieved so as to let us enjoy such cooling breeze.

8 Claims, 7 Drawing Sheets

COOLING FAN WITH THERMOSTATIC AIR OUTPUT

FIELD OF THE PRESENT INVENTION

The present invention is to provide a cooling fan with thermostatic air output, particularly for a cooling fan able to suck the air of room temperature into the fan body via the water absorbing curtain between the electric fan and the wind inlet, then blow out of the wind outlet in the fan body; because said water absorbing curtain constantly absorbs moisture of lower temperature so the air blown out becomes constant in lower temperature than ambient temperature so as to have cooling effect of breeze blown-out.

BACKGROUND OF THE INVENTION

At present, when use the electronic fan or the air conditioner to dispel heat or relieve summer heat in the room, the electronic fan definitely save more electricity than the air conditioner, but the cold room effect is relatively good with the air conditioner, and the operating way of the conventional electric fan is to drive fan blade for having high speed rotation by one motor simultaneously and to blow and send the air from rear side to the front side of the fan blade, so as to make us get blowing effect of natural wind; However, the temperature of the natural wind from said conventional electronic fan is similar to the ambient temperature, so its cooling effect is really limited.

Accordingly, someone put one basin of cold water or the ice-cubes in the front of air electronic fan outlet to let air of normal atmospheric temperature blown from the outlet can be cooled down after the heat absorption function of said cold water or ice-cubes lying to get the effect of lowering the temperature in order to obtain the cool breeze result of lower temperature.

But, the cooling method mentioned above for lowering temperature of breeze blown-out has following drawbacks:

(1) If activity space is insufficiency or limited, it become unable to adopt the cooling way by putting one basin of cold water or the ice-cubes in the front of air electronic fan outlet.

(2) Under heat absorption function, because of fast action of the cold water evaporating and the ice-cubes melting, so the supplementary cold water or the ice-cubes must often furnished, that incurs much redundant inconvenience.

SUMMARY OF THE INVENTION

The primary object of the present invention is to provide a cooling fan with thermostatic air output with a water absorbing curtain being disposed between the electric fan and the wind inlet; Wherein, a water cistern is disposed above said water absorbing curtain for supplying water of circulation; And a Thermoelectric Cooling Modules (TECM) is configured in the said water cistern for cooling down the water of circulation so that said water absorbing curtain can constantly absorb moisture of lower temperature; Then, by means of the sucking function of said electric fan in front of said water absorbing curtain, the air of normal temperature from wind inlet is sucked and blown out of the wind outlet via said water absorbing curtain, where the inlet air mixing and heat exchanging with moisture of lower temperature; Thus, the cooling effect in breeze of lower temperature by blowing action is achieved.

The other object of the present invention is to provide a cooling fan with thermostatic air output with a water cistern being disposed on the top portion of the fan body and a water reservoir being disposed at the bottom portion of the fan body; Wherein a circulation system is provided between both of said water cistern and water reservoir so that said water reservoir can constantly supply water into said water cistern so as to not only eliminate the necessity of replenishing action of supplementary water during operation but also avoid the inconvenience from putting cold water or ice-cubes in front of said wind outlet for saving space in consequence of small size and light weight.

In the following, the structural feature and the expected effect of the present invention will be described in detail by preferred exemplary embodiments in association with the accompanying drawings, of which please refer to together.

DETAILED DESCRIPTION OF THE PREFERRED EMBODIMENTS

Figure 1:
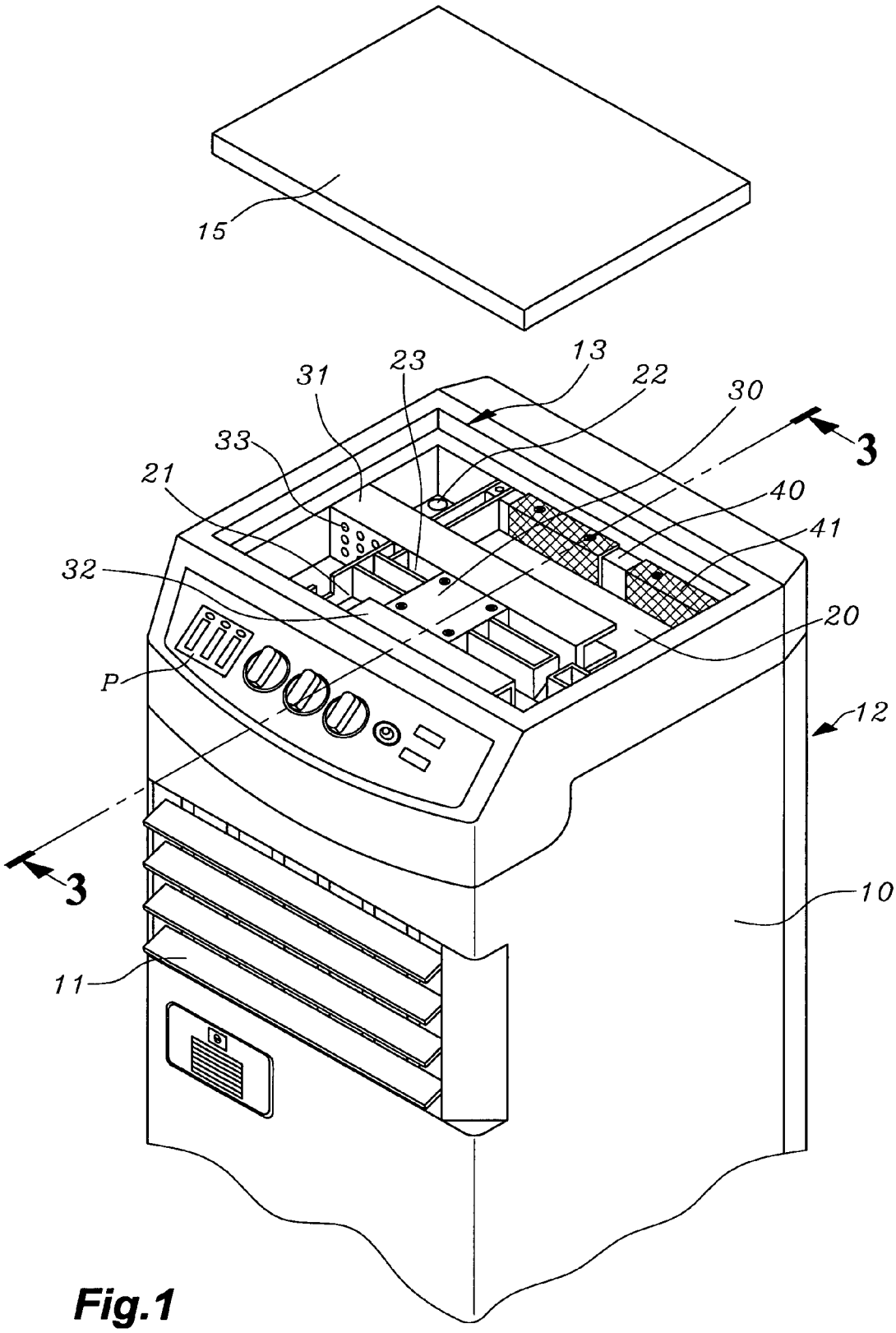
FIG. 1 is a perspective view of a cooling fan with thermostatic air output according to a first preferred embodiment of the present invention.
Figure 2:
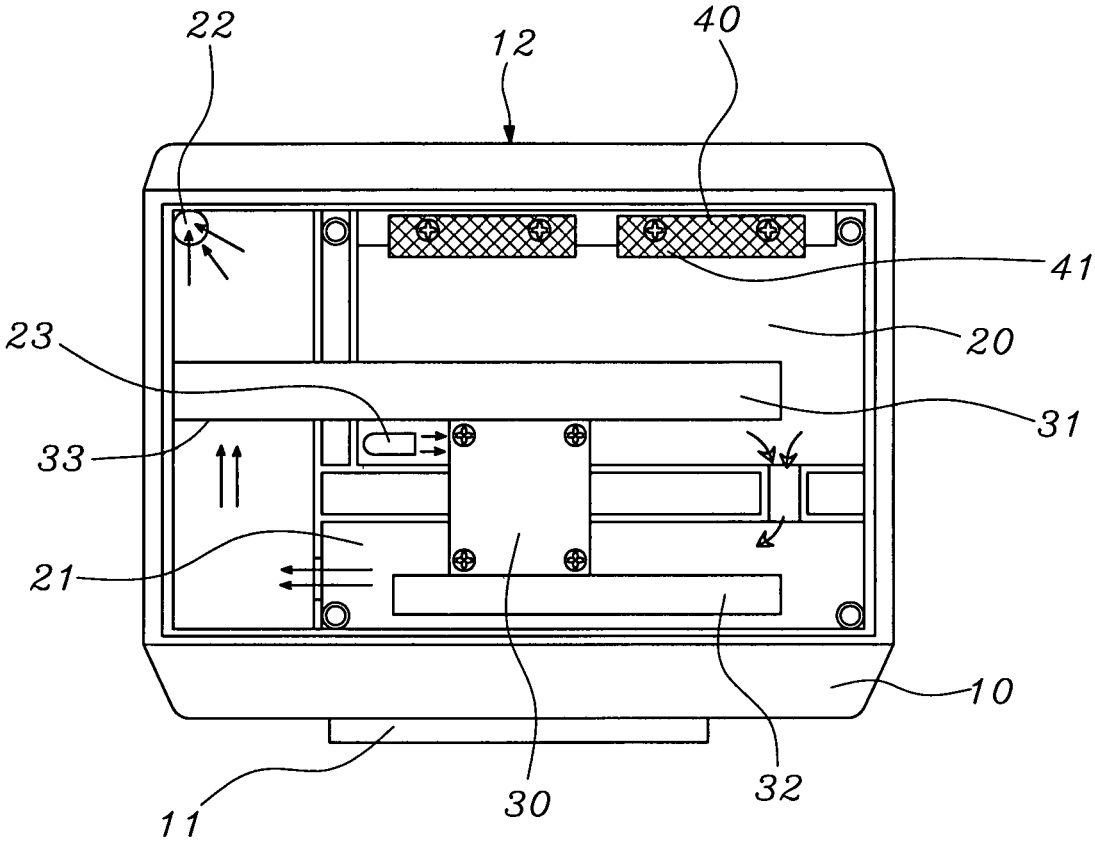
FIG. 2 is a top view of the FIG. 1.
Figure 3:
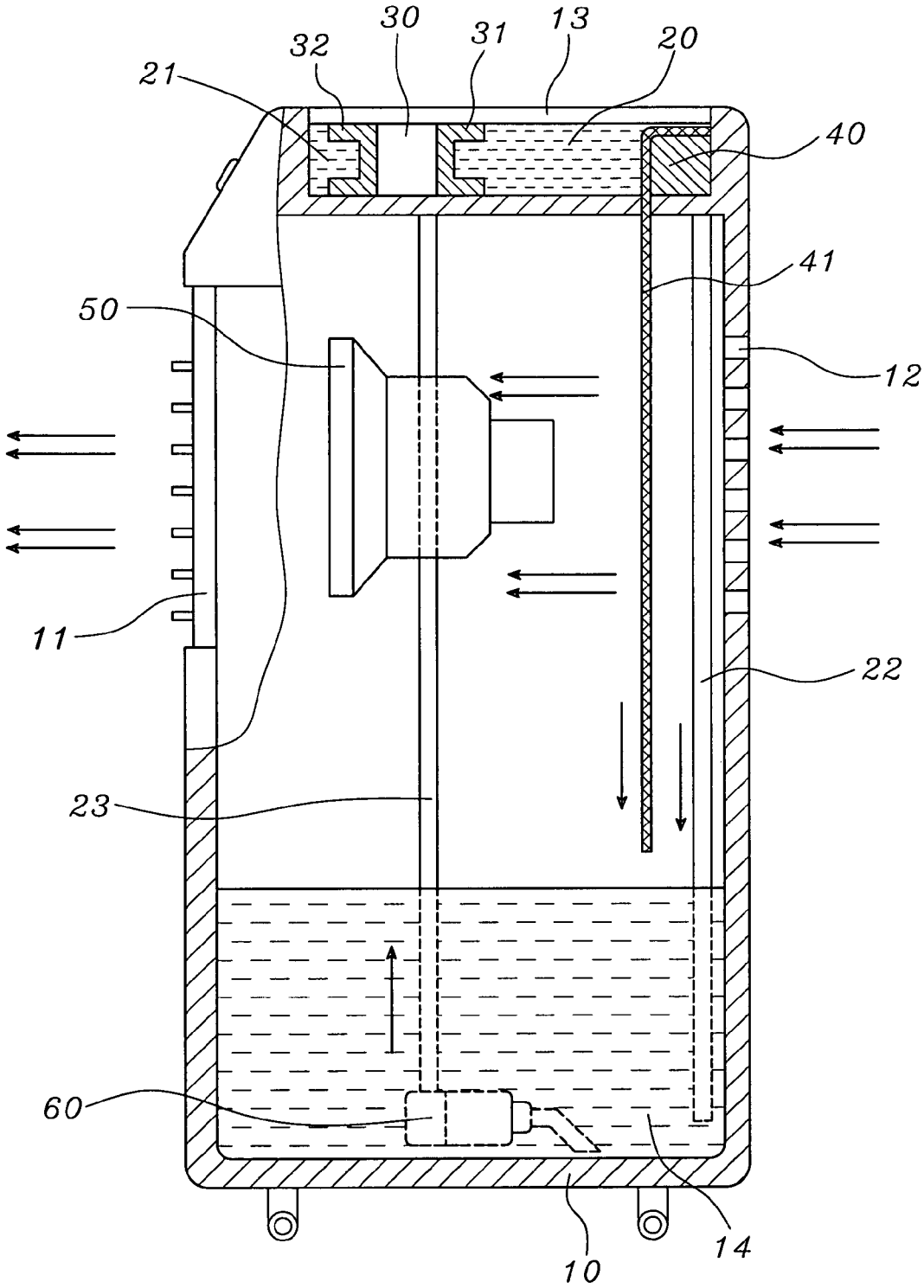
FIG. 3 is a sectional view taken along the direction indicated by a line 3-3 in FIG. 1.

Referring to FIGS. 1 to 3, a cooling fan with thermostatic air output according to a first preferred embodiment of the present invention comprises a fan body 10, a Thermoelectric Cooling Modules (TECM) 30, a first thermal conductor 31, a second thermal conductor 32, a fixing element 40, an electric fan 50 and a pump 60.

Referring to FIGS. 1 to 3, the fan body 10 has a wind outlet 11 disposed at its front side and a wind inlet 12 disposed at its rear side respectively so that both of wind outlet 11 and wind inlet 12 face each other correspondingly as well as has a water cistern 13 disposed at its top portion and a water reservoir 14 disposed at its bottom portion respectively so that said water cistern 13 contains the first water cistern 20 and the second water cistern 21 therein, wherein said first water cistern 20 has a recycling pipe 22 and a water outlet pipe 23 disposed respectively at the underside thereof downwardly up to connect with the water reservoir 14 (as shown in FIG. 3).

Referring to FIGS. 1 to 3, the Thermoelectric Cooling Modules (TECM) 30 which is straddling over the first water cistern 20 and the second water cistern 21 and being controlled by the circuit unit P for activation, has one side acted as heat sink for refrigerating function and other side acted as heat radiator for emanating function.

Referring to FIGS. 1 and 2, the first thermal conductor 31 which being disposed in the first water cistern 20, and has one side contacted and attached closely with one side of said Thermoelectric Cooling Modules (TECM) 30 in parallel manner.

Referring to FIGS. 1 and 2, the second thermal conductor 32 which being disposed in the second water cistern 21, and has one side contacted and attached closely with another side of said Thermoelectric Cooling Modules (TECM) 30 in parallel manner.

Referring to FIGS. 1 to 3, the fixing element 40 is secured in the first water cistern 20, and the top side is locked a water absorbing curtain 41.

Referring to FIG. 3, the electric fan 50 is disposed between the wind outlet 11 of the fan body 10 and water absorbing curtain 41.

Referring to FIG. 3, the pump 60 is disposed in the water reservoir 14 of the fan body 10, and connected with the free end of the water outlet pipe 23 in said water reservoir 14.

Wherein, the top surface of said first water cistern 20 is higher than that of said second water cistern 21 so that the water in said first water cistern 20 has a tendency to flow into said second water cistern 21; And, said first thermal conductor 31, which being projected on one end between both of said first water cistern 20 and second water cistern 21, has a plurality of water passing holes 33 provided for water flowing through.

Referring to FIGS. 1 to 3, by means of the combination of foregoing components, prior to the operation, the water level in the water cistern 13 of the fan body 10 must keep to predefined height by pouring into adequate water therein such that the present invention being able to start properly. When start to operate, said Thermoelectric Cooling Modules (TECM) 30 will activate by mean of the circuit unit P, meanwhile, said pump 60 in said water reservoir 14 will pump water there from up to said first water cistern 20 via said water outlet pipe 23; At this moment, one side of said Thermoelectric Cooling Modules (TECM) 30 in said first water cistern 20 acting as heat sink for refrigerating function will transfer heat absorbed to said first thermal conductor 31, which being immersed in the water with one side contacting and attaching closely with other side of said Thermoelectric Cooling Modules (TECM) 30, so as to decrease the temperature of the water passing through said first water cistern 20.

In the interim, said water of low temperature will soak the water absorbing curtain 41, which immersed in said first water cistern 20, up to entire wetting by permeating downwards; At this moment, by means of absorbing function of the fan 50 in front of said water absorbing curtain 41 relatively, the air drawn from the wind inlet 12 will pass said wetting water absorbing curtain 41 and carry the wetting molecules therein out then blown out of the wind outlet 11 by being driven of said fan 50 so as to have better low temperature effect of blown air stream.

As for the surplus moisture of said water absorbing curtain 41 will be dripped downwards into said water reservoir 14 there below for recycling and reuse.

And, the water flowing into said first water cistern 20 will gradually flow into second water cistern 21 so that the heat energy emanating on the another side of said Thermoelectric Cooling Modules (TECM) 30 in said second water cistern 21 is carried away by the passing water via contacting and attaching side of the second thermal conductor 32; Finally, the water with emanating heat energy, after passing the water passing hole 33 on said first thermal conductor 31, will flow downwards into said water reservoir 14 via recycling pipe 22 for recycling and reuse.

The water absorbing curtain 41 aforesaid can also be disposed between fan 50 and wind outlet 11 and still has equally anticipated efficiency (not shown in the FIG. 3).

The water cistern 13 aforesaid can be additionally equipped with a water level sensing and controlling element (not shown in the FIGS. 1 to 3) to control water level wherein injected to a predefined height and to timely alert warning signal and feeding water as well as disabling operation while dropping to a low water level predetermined so as to ensure the security effect; But such water level sensing and controlling element is a well-known conventional technological component, which does not involving the object and a claim of the present invention, so the redundant description thereabout is omitted.

Figure 4:
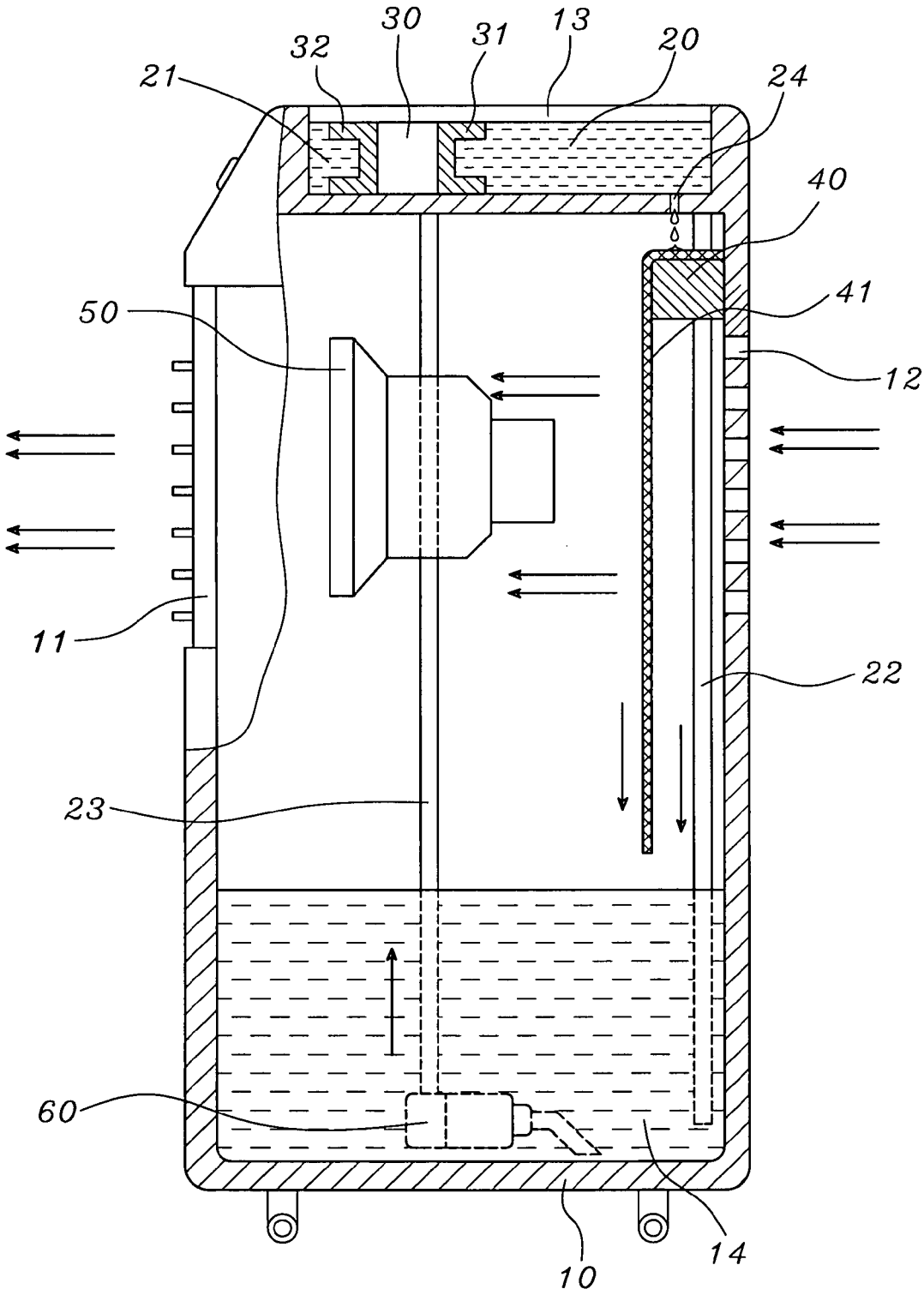
FIG. 4 is a sectional view of a cooling fan with thermostatic air output according to a second preferred embodiment of the present invention.

Please further referring to FIG. 4, a cooling fan with thermostatic air output according to a second preferred embodiment of the present invention, wherein the water absorbing curtain 41 and fixing element 40 are disposed beneath of said first water cistern 20 instead of being immersed therein as in the above first preferred embodiment; Besides, a plurality of dripping apertures 24 are punched at the underside of said first water cistern 20 corresponding to said water absorbing curtain 41 so that the water of lower temperature therein will slowly drip and wet said water absorbing curtain 41 with equivalent anticipated efficiency.

Figure 5:
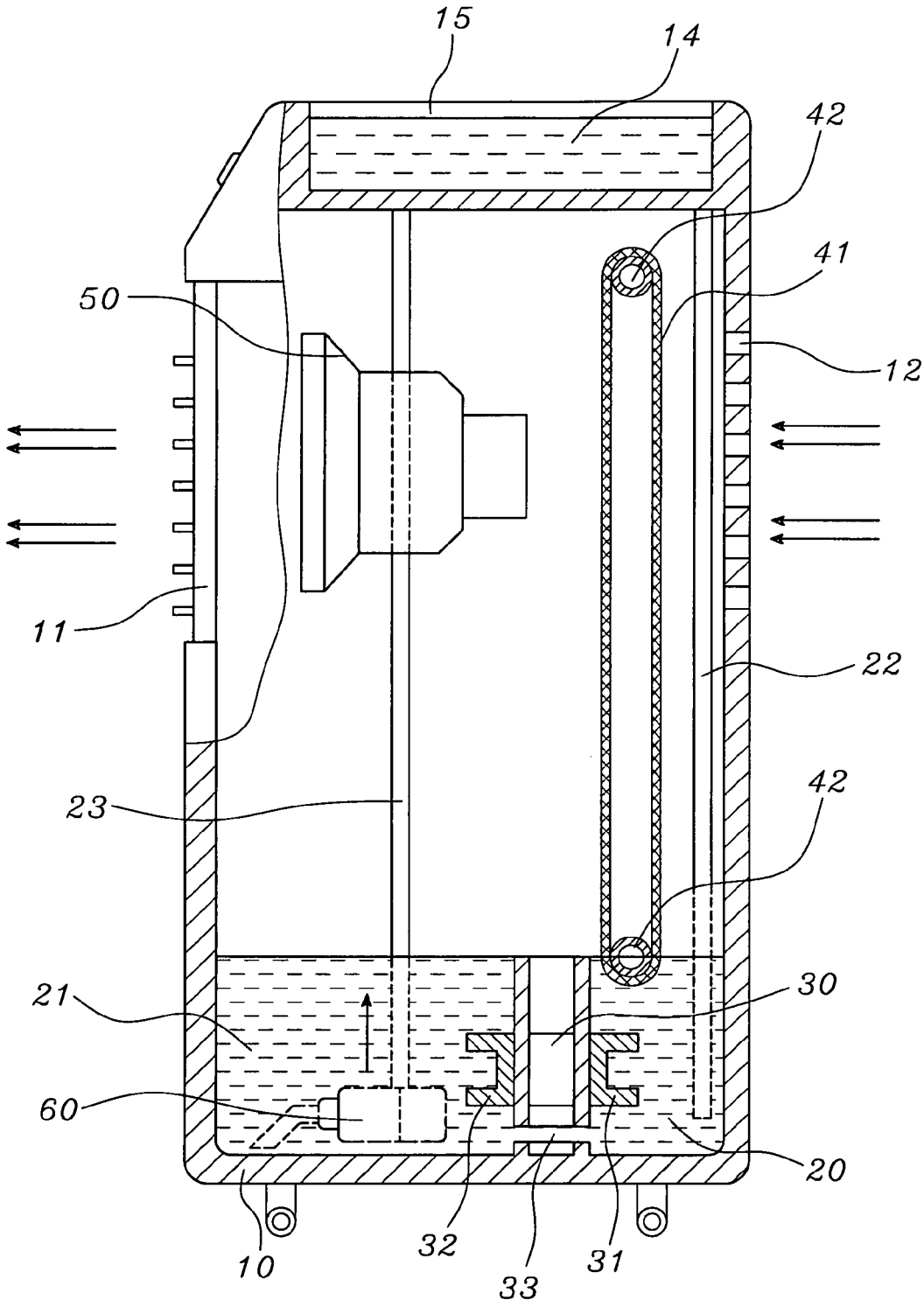
FIG. 5 is a sectional view of a cooling fan with thermostatic air output according to a third preferred embodiment of the present invention.

As further shown in FIG. 5, a cooling fan with thermostatic air output according to a third preferred embodiment of the present invention, wherein both of said water cistern 13 and water reservoir 14 are swapped each other so that said water cistern 13 is disposed at the bottom portion of the fan body 10, while said water reservoir 14 is disposed on the top portion of the fan body 10; And, the first water cistern 20, second water cistern 21, Thermoelectric Cooling Modules (TECM) 30, first thermal conductor 31 and second thermal conductor 32 are all disposed in said water cistern 13, wherein a water passing hole 33 is perforated between the first water cistern 20 and the second water cistern 21; Moreover, said water absorbing curtain 41 is formed into band loop and is retained above the first water cistern 20 of the fan body 10 by a pair of electric power driven rotating elements 42 such that being located between the wind inlet 12 of the fan body 10 and the electric fan 50; Meanwhile, the bottom portion of said water absorbing curtain 41 is extended and immersed into said water cistern 13 for being soaked by the water of lower temperature thereof with equivalent anticipated efficiency.

Figure 6:
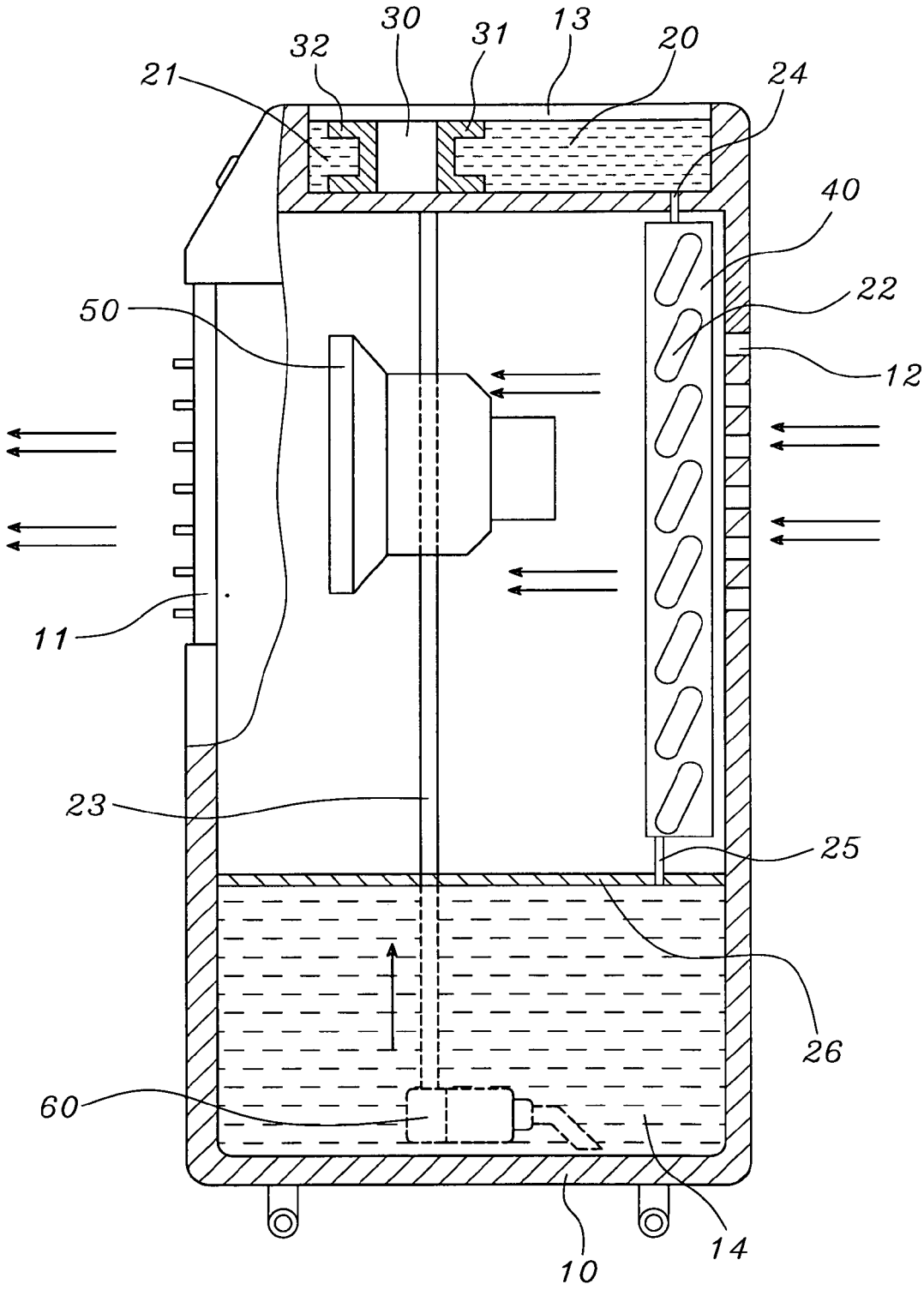
FIG. 6 is a sectional view of a cooling fan with thermostatic air output according to a fourth preferred embodiment of the present invention.
Figure 7:
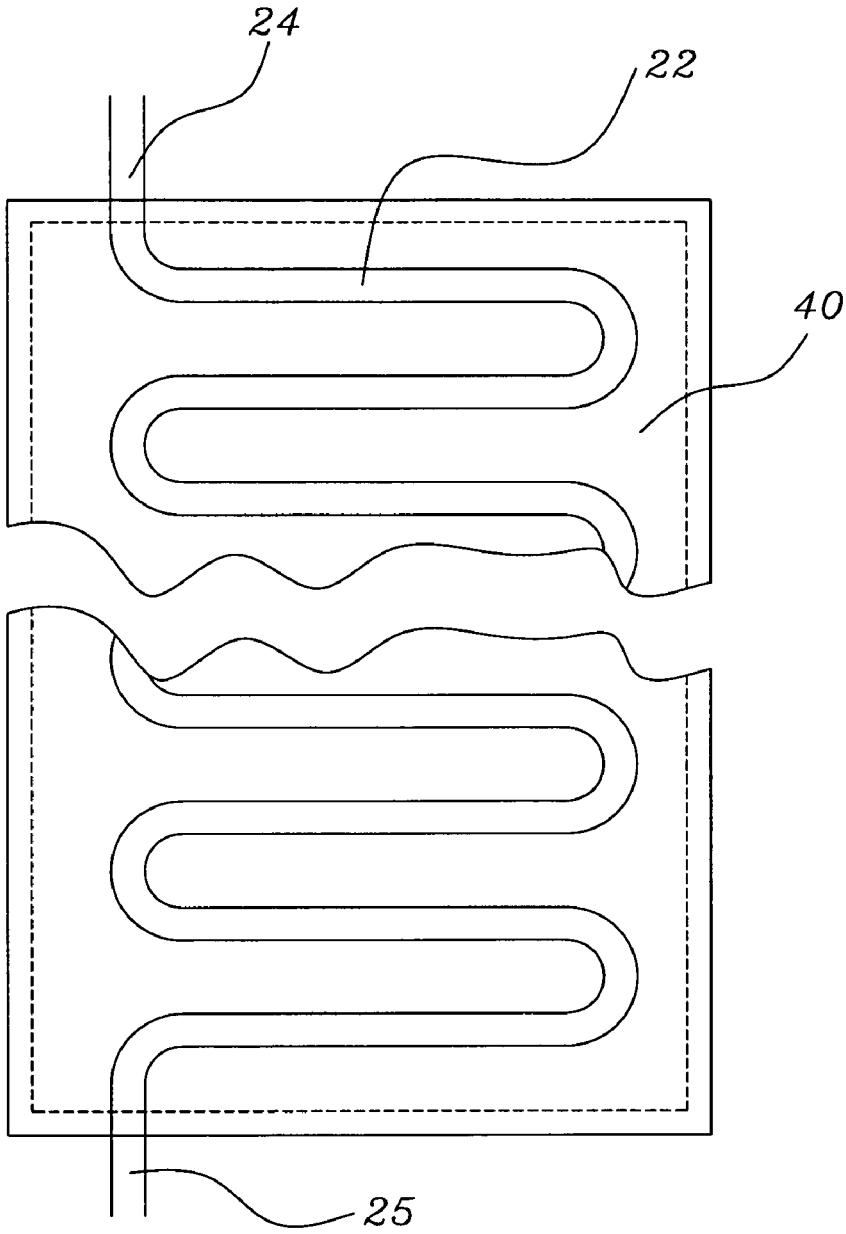
FIG. 7 is a front view of a fixing element according to a fourth preferred embodiment of the present invention.

Referring to FIGS. 6 and 7, a cooling fan with thermostatic air output according to a fourth preferred embodiment of the present invention, wherein said recycling pipe 22 in each preferred embodiment shown in foregoing FIG. 1 to FIG. 4 is designed as serpent-like tube to extend its length so as to increase contacting area of thermal conducting surface, and is firmly positioned by an external fixing element 40; Meanwhile, both of the top end and the bottom end of said recycling pipe 22 is connected with the dripping aperture 24 and extends downwards into said water reservoir 14 respectively; a partition 26, which having two adequate holes for accommodating both of water outlet pipe 23 and water guiding portion 25 running through, is disposed on the top of said water reservoir 14 so that said water reservoir 14 becomes closed condition for isolating the water therein away from the external ambient temperature so as to prevent its lower temperature from being affected. Thereby, the cooling effect can be relatively enhanced by the expansion in contacting area of thermal conducting surface on said recycling pipe 22 in such manner.

Moreover, both sides of the Thermoelectric Cooling Modules (TECM) 30, wherein each acting as heat sink for refrigerating function and acting as heat radiator for emanating function respectively, are swapped in horizontal direction by a 180° rotation manner so that the "cooled water" originally in the first water cistern 20 is converted into "preheated water" now and the "preheated water" originally in the second water cistern 21 is converted into "cooled water" now; By such way, said water absorbing curtain 41 sucks "preheated water" of higher temperature instead of "cooled water" of lower temperature as foregoing exemplary embodiments so that the warm air is blown out of the wind outlet 11 of said electric fan 50 for being used in the place, where getting heat energy to dispel coolness needed.

In conclusion, the present invention has feature of simple structure, easy manufacturing production, small volume, light weight and handy operation as well as multiple practical efficiency, such as the electricity-saving economy, environmental protection and the like, especially in accordance with the environment and occasion for dispelling heat and lower the temperature or getting warm in different seasons, freely swapping adjustment and assemble, and can become the extensive suitable scientific and technological product of innovation to be used in winter or summer in freedom.

What is claimed is:

1. A cooling fan with thermostatic air output comprising:

a fan body has a wind outlet disposed at its front side and a wind inlet disposed at its rear side respectively so that both the wind outlet and the wind inlet face each other correspondingly as well as has a water cistern disposed at its top portion and a water reservoir disposed at its bottom portion respectively so that said water cistern contains a first water cistern and a second water cistern therein, wherein said first water cistern has a recycling pipe and a water outlet pipe disposed respectively at the underside thereof downwardly up to connect with the water reservoir;

a Thermoelectric Cooling Modules (TECM) straddling over said first water cistern and said second water cistern and being controlled by a circuit unit for activation, and having one side acting as a heat sink for refrigerating function and other side acting as a heat radiator for emanating function;

a first thermal conductor being disposed in said first water cistern, and having one side contacted and attached closely with one side of said Thermoelectric Cooling Modules (TECM) in parallel manner;

a second thermal conductor being disposed in said second water cistern, and having one side contacted and attached closely with another side of said Thermoelectric Cooling Modules (TECM) in parallel manner;

a fixing element secured in said first water cistern and having a water absorbing curtain locked in a top side thereof;

an electric fan disposed between the wind outlet of said fan body and the water absorbing curtain; and a pump disposed in the water reservoir of said fan body, and connected with a free end of the water outlet pipe in said water reservoir.

2. A cooling fan with thermostatic air output as recited in the claim 1, wherein the top surface of said first water cistern is higher than that of said second water cistern.

3. A cooling fan with thermostatic air output as recited in the claim 1, wherein said first thermal conductor is projected on one end between both of said first water cistern and said second water cistern, and has a plurality of water passing holes therein.

4. A cooling fan with thermostatic air output as recited in the claim 1, wherein said water absorbing curtain is located between said fan and the wind inlet of said fan body.

5. A cooling fan with thermostatic air output as recited in the claim 1, wherein said water absorbing curtain and said fixing element are disposed beneath said first water cistern, and has a plurality of dripping apertures punched at the underside of said first water cistern corresponding to said water absorbing curtain.

6. A cooling fan with thermostatic air output as recited in the claim 1, wherein both of said water cistern and said water reservoir are swapped each other so that said water cistern is disposed at the bottom portion of said fan body, while said water reservoir is disposed on the top portion of said fan body, and further said first water cistern, said second water cistern, said Thermoelectric Cooling Modules (TECM), said first thermal conductor and said second thermal conductor are all disposed in said water cistern, wherein a water passing hole is perforated between said first water cistern and said second water cistern, and said water absorbing curtain is formed into band loop and is retained above said first water cistern of the fan body by a pair of electric power driven rotating elements such that being located between the wind inlet of said fan body and said fan; and the bottom portion of said water absorbing curtain is extended and immersed into said water cistern.

7. A cooling fan with thermostatic air output as recited in the claim 1, wherein said recycling pipe is designed as serpent-like tube to extend its length, and is firmly positioned by an external fixing element; and both of the top end and the bottom end of said recycling pipe is connected with the dripping aperture and extends downwards into said water reservoir respectively; a partition, which has two adequate holes for accommodating both of said water outlet pipe and said water guiding portion running through, which is disposed on the top of said water reservoir.

8. A cooling fan with thermostatic air output as recited in the claim 1, wherein both sides of said Thermoelectric Cooling Modules (TECM) are swapped in horizontal direction by a 180° rotation.

* * * * *